US012453905B2

(12) United States Patent
Engle

(10) Patent No.: US 12,453,905 B2
(45) Date of Patent: Oct. 28, 2025

(54) GOLF BALL DIMPLE PROFILE DEFINED BY MODIFIED CYCLOID CURVE

(71) Applicant: Acushnet Company, Fairhaven, MA (US)

(72) Inventor: Courtney N. Engle, Fall River, MA (US)

(73) Assignee: Acushnet Company, Fairhaven, MA (US)

( * ) Notice: Subject to any disclaimer, the term of this patent is extended or adjusted under 35 U.S.C. 154(b) by 130 days.

(21) Appl. No.: 18/401,554

(22) Filed: Dec. 31, 2023

(65) Prior Publication Data

US 2025/0213926 A1 Jul. 3, 2025

(51) Int. Cl.
*A63B 37/06* (2006.01)
*A63B 37/00* (2006.01)

(52) U.S. Cl.
CPC ..... *A63B 37/0012* (2013.01); *A63B 37/0019* (2013.01); *A63B 37/002* (2013.01)

(58) Field of Classification Search
CPC ..... A63B 37/0012; A63B 37/0019; A63B 37/002
See application file for complete search history.

(56) References Cited

U.S. PATENT DOCUMENTS

| | | | | |
|---|---|---|---|---|
| 4,925,193 | A | 5/1990 | Melvin | |
| 5,249,804 | A | 10/1993 | Sanchez | |
| 5,562,552 | A | 10/1996 | Thurman | |
| 5,575,477 | A | 11/1996 | Hwang | |
| 5,713,801 | A | 2/1998 | Aoyama | |
| 5,885,172 | A | 3/1999 | Hebert | |
| 5,919,100 | A | 7/1999 | Boehm | |
| 5,965,669 | A | 10/1999 | Cavallaro | |
| 5,981,654 | A | 11/1999 | Rajagopalan | |
| 5,981,658 | A | 11/1999 | Rajagopalan | |
| 6,149,535 | A | 11/2000 | Bissonnette | |
| 7,361,102 | B2 | 4/2008 | Ladd | |
| 7,927,233 | B2 | 4/2011 | Sullivan | |
| 8,079,921 | B2 | 12/2011 | Sato | |
| 8,834,300 | B2 | 9/2014 | Sullivan | |
| 8,845,456 | B2 | 9/2014 | Comeau | |
| 9,205,308 | B2 | 12/2015 | Sullivan | |
| 9,795,836 | B2 | 10/2017 | Comeau | |
| 2007/0259738 | A1* | 11/2007 | Sato | A63B 37/0021 473/378 |

* cited by examiner

*Primary Examiner* — Raeann Gorden
(74) *Attorney, Agent, or Firm* — Thomas P. Gushue

(57) ABSTRACT

Various aspects of a dimple pattern for a golf ball are disclosed herein. In one aspect, the golf balls disclosed herein can include dimples having a profile that is defined by a modified cycloid curve.

14 Claims, 3 Drawing Sheets

GOLF BALL DIMPLE PROFILE DEFINED BY MODIFIED CYCLOID CURVE

FIELD OF THE INVENTION

This disclosure generally relates to a golf ball, and is more particularly related to a specific cross-sectional profile for a dimple on a golf ball.

BACKGROUND OF THE INVENTION

Various dimple pattern designs are well known. Various golf ball dimple profiles are also well known, which can include different cross-sectional profiles and/or planar profiles.

Aerodynamics continues to be a critical aspect of golf ball design, and there is an ever-present demand for improved configurations that provide for greater variability of parameters associated with designing the dimple cross-sectional profile.

It would be desirable to provide an improved configuration for dimple design that allows for said greater variability, among other advantages.

SUMMARY OF THE INVENTION

In some aspects, the present disclosure is directed to a golf ball that includes dimples having a cross-sectional profile defined by a modified cycloid curve. The term modified cycloid curve is described in further detail herein.

In one aspect, a golf ball is disclosed that has a plurality of dimples on a surface thereof, wherein at least a subset of the plurality of dimples has a cross-sectional dimple profile defined by x-y coordinates, wherein x=0 corresponds to a central axis of the cross-sectional dimple profile, y=0 corresponds to the chord plane of the dimple, and the chord depth $c_d$ is a maximum depth of the cross-sectional dimple profile which is defined at the central axis, and the cross-sectional dimple profile is symmetrical about the central axis.

A cross-sectional dimple profile of the golf ball can be defined by a modified cycloid curve, and the modified cycloid curve can be rotated about the central axis to define the cross-sectional dimple profile of the plurality of dimples.

In one aspect, the modified cycloid curve is defined by:

$$\begin{cases} x = \frac{D}{2\pi}(\theta - \sin\theta) - \frac{D}{2} \\ y = \frac{c_d}{2}(\cos\theta - 1) \end{cases} \text{ with } 0 \le \theta < 2\pi,$$

where D is a dimple diameter, $c_d$ is a chord depth, and θ is an angular displacement along the modified cycloid curve.

In one aspect, the cross-sectional dimple profile has a continuously variable radius of curvature.

One of ordinary skill in the art would understand that the quantity of dimples having the modified cycloid curve profile can vary. In one aspect, the subset of the plurality of the dimples defined by the modified cycloid curve can include at least 50% of a total quantity of the plurality of dimples. In one aspect, the subset of the plurality of the dimples defined by the modified cycloid curve can include no greater than 50% of a total quantity of the plurality of dimples. In one aspect, the subset of the plurality of the dimples defined by the modified cycloid curve can include at least 75% of a total quantity of the plurality of dimples.

In one aspect, the subset of the plurality of the dimples defined by the modified cycloid curve can include 100% of a total quantity of the plurality of dimples.

Based on the present disclosure, the dimple diameter and the chord depth are decoupled from each other, in one aspect. Stated differently, the dimple diameter and the chord depth are independent of each other, and the value of one of these parameters does not affect the value of the other one of the parameters when forming the dimple profile.

The dimple diameter can vary, as one of ordinary skill in the art would understand. The dimple diameter can be 0.100 inches-0.200 inches, in one aspect. In another aspect, the dimple diameter can be 0.125 inches-0.180 inches. In another aspect, the dimple diameter can be 0.100 inches-0.225 inches. In one aspect, the dimple pattern on any given golf ball can include dimples having a single dimple diameter or a plurality of dimple diameters. A golf ball can include dimples having various dimple diameters that each have a profile defined by a modified cycloid curve.

In one aspect, the chord depth can be 0.0025 inches-0.0075 inches. In yet another aspect, the chord depth can be 0.0040 inches-0.0055 inches. The chord depth can vary, as one of ordinary skill in the art would appreciate. In one aspect, the dimple pattern on any given golf ball can include dimples having a single chord depth or a plurality of chord depths. A golf ball can include dimples having various chord depths that each have a profile defined by a modified cycloid curve.

Additional features and aspects of the present disclosure are described in further detail herein.

BRIEF DESCRIPTION OF THE DRAWINGS

Further features and advantages of the present disclosure can be ascertained from the following detailed description that is provided in connection with the drawings described below.

DETAILED DESCRIPTION OF THE INVENTION

Figure 1:
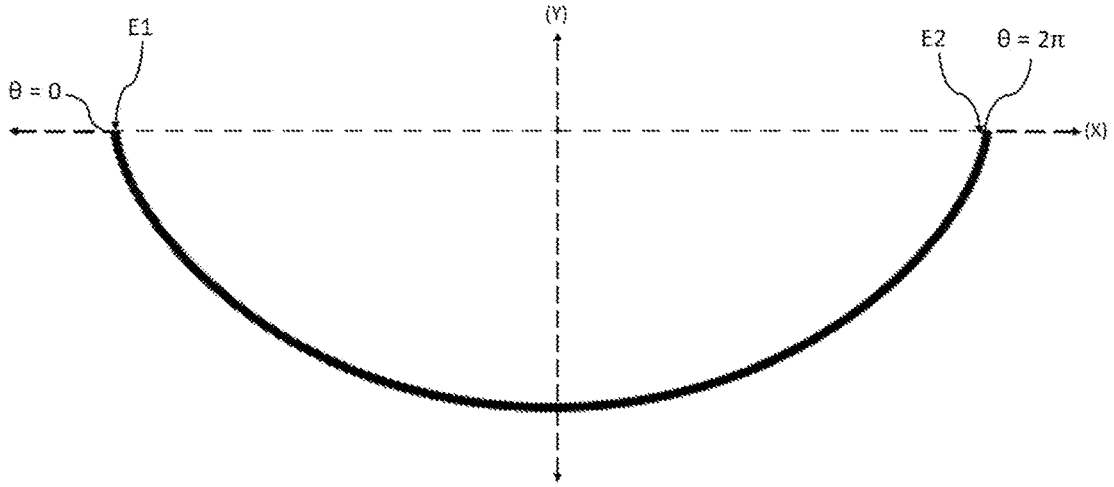
FIG. 1 is an exemplary diagram of a cycloid curve according to one aspect.

Details of a modified cycloid curve for use in designing a golf ball dimple profile are provided herein. As shown in FIG. 1, which illustrates a cycloid curve, a first side edge (E1) of the cycloid curve can be defined at θ=0, and an opposite, second side edge (E2) of the cycloid curve can be defined at θ=2π. The cycloid curve in FIG. 1 can be modified to provide a dimple profile.

In one aspect, the following parametric equations can define a dimple profile created by using a modified cycloid curve and having a central axis located at x=0:

$$\begin{cases} x = \frac{D}{2\pi}(\theta - \sin\theta) - \frac{D}{2} \\ y = \frac{c_d}{2}(\cos\theta - 1) \end{cases} \text{ with } 0 \le \theta < 2\pi,$$

where D is the dimple diameter, $c_d$ is the chord depth, and θ is an angular displacement along the modified cycloid curve.

Figure 2:
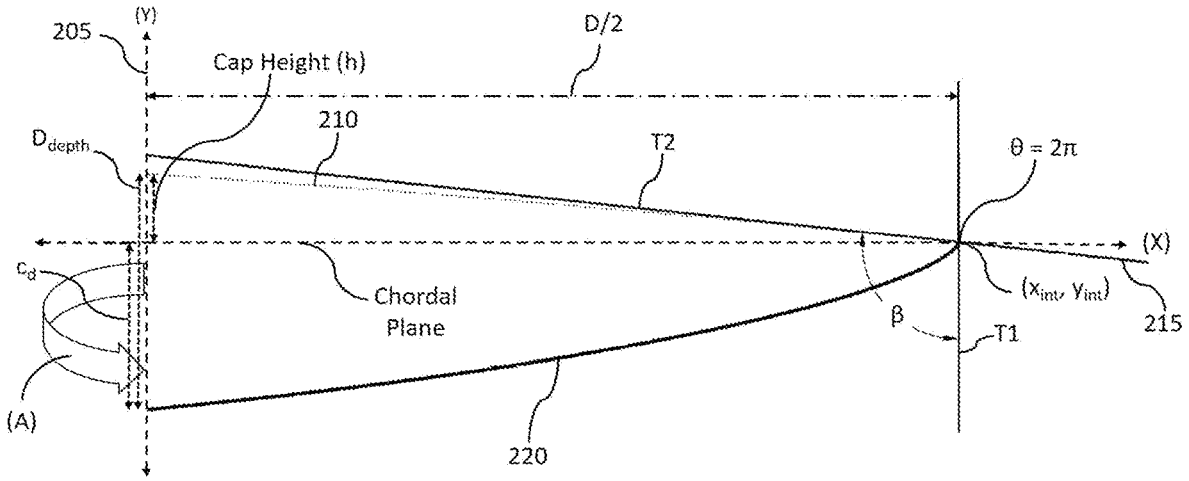
FIG. 2 is a diagram of a dimple half-profile defined by a modified cycloid curve according to one aspect.

A three-dimensional dimple geometry can be formed by rotating the modified cycloid curve around the central axis, x=0. An exemplary arrow (A) showing this rotation is shown in FIG. 2. The cross-sectional dimple half profile shown in FIG. 2 includes annotations at least for an intersection angle β, a pair of tangent lines (T1, T2), a dimple centerline 205 (at x=0), a phantom surface 210, a dimple-free ball spherical surface 215 (also referred to herein as a land surface 215), and a modified cycloid profile curve 220.

As shown in FIG. 2, the intersection angle β of the profile can be defined as an angle measured between: (i) a first line (T1) that is tangent to the modified cycloid curve 220 at an intersection point ($x_{int}$, $y_{int}$) defined between the dimple-free spherical surface 215 and the modified cycloid profile curve 220, and (ii) a second line (T2) that is tangent to the dimple-free spherical surface 215 at the intersection point ($x_{int}$, $y_{int}$) defined between the dimple-free spherical surface 215 and the modified cycloid profile curve 220.

The intersection angle of the dimples defined by the modified cycloid curve can be relatively large as compared to traditional golf ball dimples. In one aspect, the intersection angle of each dimple among the subset of the plurality of dimples can be least 45 degrees. In one aspect, the intersection angle of each dimple among the subset of the plurality of dimples can be least 60 degrees. In one aspect, the intersection angle of each dimple among the subset of the plurality of dimples can be least 90 degrees, or at least 95 degrees.

In one aspect, the present disclosure employs a modified cycloid curve because an ordinary cycloid curve would necessitate unacceptable design parameters, such as an inordinately high chord depth, or necessitate only using a limited portion of the ordinary cycloid curve.

Referring back to FIG. 2, the chordal volume of the dimple $V_{chord}$ can be calculated using the following formula:

$$V_{chord} = \frac{c_d D^2}{48\pi}(9\pi^2 - 16),$$

and with the volume of the spherical cap $V_{cap}$ defined by:

$$V_{cap} = \pi h^2\left(\frac{D}{2} - 3h\right),$$

where h is the cap height (which is illustrated in FIG. 2). In one aspect, the cap height is defined by:

$$h = \frac{D}{2} - \frac{1}{2}\sqrt{D_{ball}^2 - D^2},$$

where $D_{ball}$ is a diameter of the golf ball.

The total volume of the dimple $V_{total}$ (i.e., total dimple volume) is therefore defined by:

$$V_{total} = V_{chord} + V_{cap}$$

By the term "total dimple volume," it is meant the total volume encompassed by the dimple surface and the phantom surface of the golf ball.

In one aspect, the dimple-free golf ball surface is defined by:

$$x_{ball}^2 + \left(y_{ball} + \frac{D_{ball}}{2} - h\right)^2 = \frac{D_{ball}^2}{4},$$

where $x_{ball}$ and $y_{ball}$ are the paired x- and y-coordinates defining the undimpled ball surface.

The present methodology preserves the steep inclination of the regular or unmodified cycloid curve at the side edges of the dimple or ends of the profile (i.e., where θ=0 and θ=2π), and therefore the tangent line of the modified cycloid curve where it intersects the undimpled ball surface (i.e., at (−D/2, 0) and (D/2, 0) is a vertical line.

As used in this context, the term "modified cycloid curve" can refer to a cycloid curve that has been modified to be driven by dimple diameter and chord depth as opposed to being only dependent on the radius of the circle that is rotated to create the unmodified cycloid curve.

A slope of the line (i.e., line T2) that is tangent to the dimple-free spherical surface at the positive intersection point (D/2, 0) can be given by the first derivative:

$$\frac{dy}{dx} = \frac{-D}{\sqrt{D_{ball}^2 - D^2}}$$

The intersection angle β can then be defined by:

$$\beta = a\tan\left(\frac{-D}{\sqrt{D_{ball}^2 - D^2}}\right) + 90°,$$

where the 90-degree addition is the contribution from the tangent line (T1) of the modified cycloid curve.

One of ordinary skill in the art will understand that a similar calculation or derivation can be undertaken for a negative intersection point, i.e., (−D/2, 0), which can also be used to provide the same resulting intersection angle β.

Accordingly, using the methodology of the present disclosure allows for the intersection angle β at the intersection of the undimpled golf ball surface (i.e., land surface) and the dimpled surface to be greater than 90 degrees, in one aspect.

In one aspect, a golf ball is disclosed that has a plurality of dimples on a surface thereof, wherein at least a subset of the plurality of dimples has a cross-sectional dimple profile defined by x-y coordinates, wherein x=0 corresponds to a central axis of the cross-sectional dimple profile, $y=-c_d$ corresponds to a maximum depth of the cross-sectional dimple profile which is defined at the central axis, and the cross-sectional dimple profile is symmetrical about the central axis.

A cross-sectional dimple profile of the golf ball can be defined by a modified cycloid curve, and the modified cycloid curve can be rotated about the central axis to define the cross-sectional dimple profile of the plurality of dimples.

In one aspect, the modified cycloid curve can be defined by:

$$\begin{cases} x = \frac{D}{2\pi}(\theta - \sin\theta) - \frac{D}{2} \\ y = \frac{c_d}{2}(\cos\theta - 1) \end{cases} \text{ with } 0 \le \theta < 2\pi.$$

In one aspect, the x-coordinate of the modified cycloid curve is only dependent on the dimple diameter and the angular displacement along the modified cycloid curve, and the x-coordinate is not dependent on the chord depth. In one aspect, the y-coordinate of the modified cycloid curve is only dependent on the chord depth and the angular displacement along the modified cycloid curve, and the y-coordinate is not dependent on the dimple diameter. In this way, the modified cycloid curve can provide for a design solution of dimple profiles that decouples the dimple diameter from the chord depth. In one aspect, this feature allows for vastly improved design flexibility of two critical aspects of dimple design (i.e., dimple diameter and chord depth), while simultaneously leveraging the accelerating effects of a Brachistochrone or cycloid curve. As disclosed herein, the present dimple profile utilizes a modified cycloid profile, in one aspect, such that air flowing over the golf ball surface will encounter a sharp drop based on the relatively large intersection angle of the dimple profile, thereby resulting in rapid downward acceleration and energization of the turbulent boundary layer which reduces drag force acting on the golf ball and improves flight stability.

The intersection angles of the dimples defined by the modified cycloid curve can be relatively large compared to many commercially available golf balls. In one aspect, an intersection angle of each dimple among the subset of the plurality of dimples can be least 45 degrees. In one aspect, an intersection angle of each dimple among the subset of the plurality of dimples can be least 60 degrees. In one aspect, an intersection angle of each dimple among the subset of the plurality of dimples can be least 90 degrees. In one aspect, an intersection angle of each dimple among the subset of the plurality of dimples can be least 90-100 degrees.

One of ordinary skill in the art would understand that the quantity of dimples having the modified cycloid curve profile can vary. In one aspect, the subset of the plurality of the dimples defined by the modified cycloid curve can include at least 50% of a total quantity of the plurality of dimples. In one aspect, the subset of the plurality of the dimples defined by the modified cycloid curve can include at least 75% of a total quantity of the plurality of dimples. In one aspect, the subset of the plurality of the dimples defined by the modified cycloid curve can include 25%-90% of a total quantity of the plurality of dimples. In one aspect, the subset of the plurality of the dimples defined by the modified cycloid curve can include 100% of a total quantity of the plurality of dimples.

In one aspect, the dimples defined by the modified cycloid curve can cover at least 50% of a total surface area of the golf ball. In another aspect, the dimples defined by the modified cycloid curve can cover at least 70% of a total surface area of the golf ball.

Based on the present disclosure, the dimple diameter and the chord depth can be decoupled from each other, in one aspect. Stated differently, the dimple diameter and the chord depth can be independent of each other, and the value of one of these parameters does not affect the value of the other one of the parameters.

The dimple diameter can vary, as one of ordinary skill in the art would understand. The dimple diameter can be 0.120 inches-0.200 inches, in one aspect. In another aspect, the dimple diameter can be 0.125 inches-0.180 inches. In yet another aspect, the dimple diameter can be 0.100 inches-0.225 inches.

The chord depth can vary, as one of ordinary skill in the art would understand. In one aspect, the chord depth can be 0.0040 inches-0.0055 inches. In yet another aspect, the chord depth can be 0.0045 inches-0.0050 inches. In yet another aspect, the chord depth can be 0.0025 inches-0.0075 inches.

Various specific dimple profiles are described below. One of ordinary skill in the art would understand based on this disclosure that any one or more of the values can vary. In each of the FIGS. 3A-3D, an x-y coordinate system is illustrated and the units for the illustrated scales are in inches.

Figure 3A:
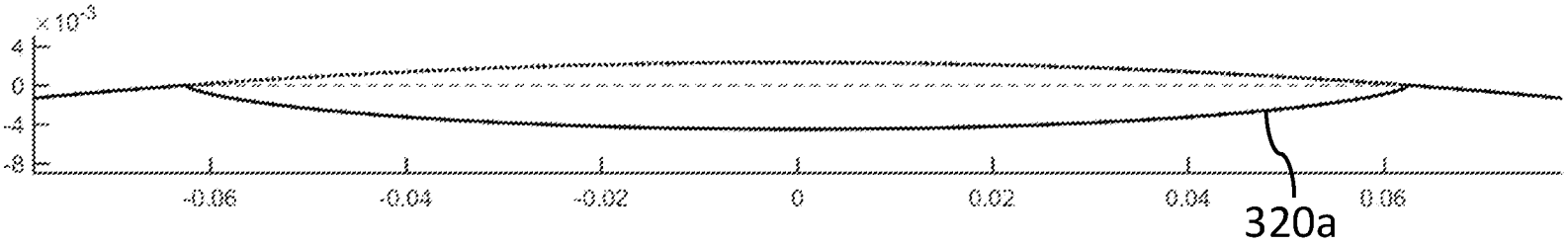
FIG. 3A is a diagram of a dimple profile defined by a modified cycloid curve according to one aspect.

In a first example, as shown by modified cycloid profile curve 320*a* in FIG. 3A, the dimple diameter is no greater than 0.125 inches, the chord depth is no greater than 0.0045 inches, and a total volume of the dimple $V_{total}$ is at least 0.00004825 $in^3$. In one aspect, the modified cycloid profile curve 320*a* of FIG. 3A has an intersection angle of 94.3 degrees, a spherical cap volume $V_{cap}$ of 0.00001429 $in^3$, and a modified cycloidal volume $V_{cycloid}$ of 0.00003396 $in^3$.

Figure 3B:
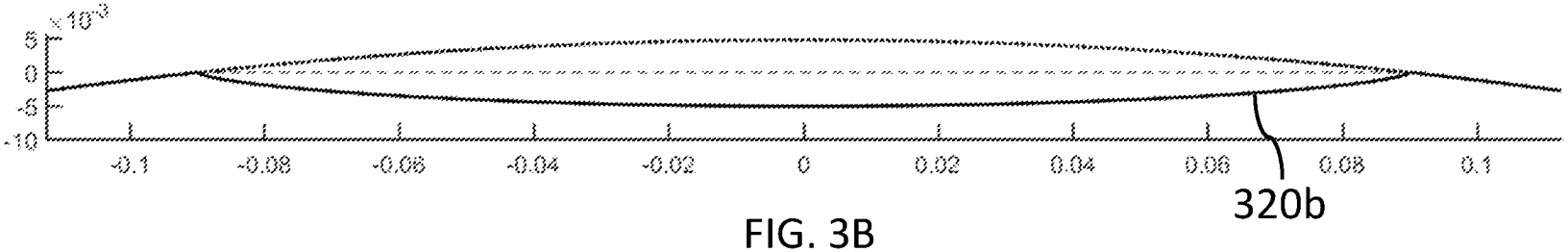
FIG. 3B is a diagram of a dimple profile defined by a modified cycloid curve according to another aspect.

In a second example, as shown by modified cycloid profile curve 320*b* in FIG. 3B, the dimple diameter is no greater than 0.180 inches, the chord depth is no greater than 0.0050 inches, and a total volume of the dimple $V_{total}$ is at least 0.0001398 $in^3$. In one aspect, the modified cycloid profile curve 320*b* of FIG. 3B has an intersection angle of 96.2 degrees, a spherical cap volume $V_{cap}$ of 0.00006158 $in^3$, and a modified cycloidal volume $V_{cycloid}$ of 0.00007824 $in^3$.

Figure 3C:
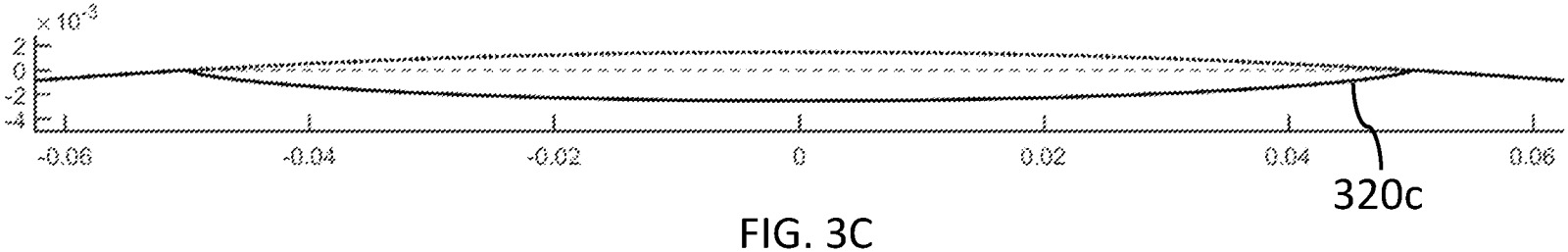
FIG. 3C is a diagram of a dimple profile defined by a modified cycloid curve according to another aspect.

In a third example, as shown by modified cycloid profile curve 320*c* in FIG. 3C, the dimple diameter is no greater than 0.100 inches, the chord depth is no greater than 0.0025 inches, and a total volume of the dimple $V_{total}$ is at least 0.00004207 $in^3$. In one aspect, the modified cycloid profile curve 320*c* of FIG. 3C has an intersection angle of 93.4 degrees, a spherical cap volume $V_{cap}$ of 0.000005851 $in^3$, and a modified cycloidal volume $V_{cycloid}$ of 0.00003622 $in^3$.

Figure 3D:
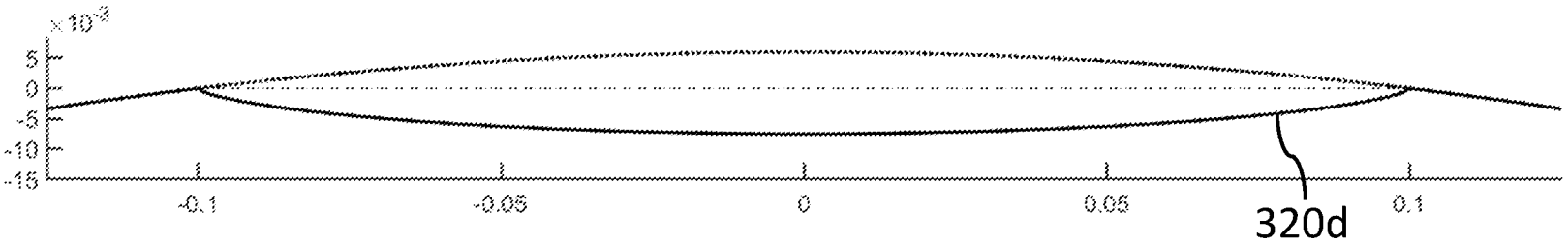
FIG. 3D is a diagram of a dimple profile defined by a modified cycloid curve according to another aspect.

In a fourth example, as shown by modified cycloid profile curve 320*d* in FIG. 3D, the dimple diameter is no greater than 0.200 inches, the chord depth is no greater than 0.0075 inches, and a total volume of the dimple $V_{total}$ is at least 0.0002388 $in^3$. In one aspect, the modified cycloid profile curve 320*d* of FIG. 3D has an intersection angle of 96.8 degrees, a spherical cap volume $V_{cap}$ of 0.00009395 $in^3$, and a modified cycloidal volume $V_{cycloid}$ of 0.0001449 $in^3$.

FIGS. 3A-3D provide various exemplary profiles according to some aspects of the present disclosure. One of ordinary skill in the art would understand based on the present disclosure that various parameters of these profiles can be modified to provide target or desired aerodynamic characteristics, and the specific values are provided for exemplary purposes only. In one aspect, the modified cycloid profile curve can result in total dimple volumes of 0.000018 $in^3$-0.000334 $in^3$ for chord depths between 0.0025 inches-0.0075 inches and dimple diameters between 0.100 inches-0.225 inches.

Figure 3E:
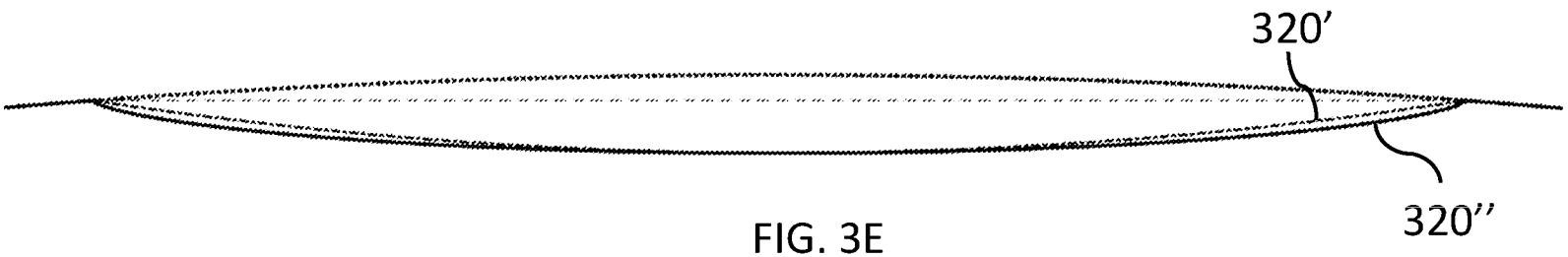
FIG. 3E is a diagram of a first dimple profile shown by a solid line defined by a modified cycloid curve according to another aspect, and a second dimple profile shown by dashed lines defined by a circular arc overlaid on the modified cycloid curve.

FIG. 3E further illustrates a dimple profile 320' defined by a circular arc in dashed lines and a dimple profile defined by a modified cycloid profile curve 320" in solid lines. In one aspect, the present disclosure provides for a relative increase in a total volume of a dimple as compared to other known dimple profiles. For example, the present disclosure can provide a total dimple volume that is at least 15% greater than a total dimple volume having a profile that is defined by a circular arc curve. As shown in FIG. 3E, a periphery of the modified cycloid profile curve 320" (i.e., ends of the curve adjacent to the land surface) has a greater depth as compared to the dimple profile 320'. The cycloid curve provides for a steeper drop from the land surface of the golf ball, in one aspect.

In one aspect, the cross-sectional dimple profile has a continuously variable radius of curvature. In one aspect, the cross-sectional dimple profile has a relatively smaller radius of curvature near side edges or ends near the land surface as compared to the radius of curvature at the center of the dimple profile. One of ordinary skill in the art would understand that the radius of curvature value can vary in any region of the dimple profile.

In one aspect, the dimples can have a planar profile that is either circular or non-circular. The planar profile of the dimples can be modified, as one of ordinary skill in the art would appreciate.

One of ordinary skill in the art would understand that the use of cycloid curve or modified cycloid curve can be used in various alternative configurations. In one aspect, an entire range of angles (i.e., $\theta=0$ to $\theta=2\pi$) through which a rolling circle of a cycloid is rotated is utilized to define the dimple profile. Stated differently, a full angular parametric sweep of a cycloid can be utilized to define the dimple profile, as opposed to a truncated cycloid profile or only utilizing a portion of the cycloid profile.

The present disclosure may be used with any type of golf ball construction. For instance, the golf ball may have a 2-piece construction, a double cover or veneer cover construction or other multi-layer constructions depending on the type of performance desired of the ball. Examples of these and other types of ball constructions that may be used with the present disclosure include those described in U.S. Pat. Nos. 5,713,801, 5,885,172, 5,919,100, 5,965,669, 5,981,654, 5,981,658, and 6,149,535, which are each incorporated in their entirety as if fully set forth herein.

Further exemplary golf ball constructions, including further details on the various layers, materials, dimensions, and other characteristics of golf balls are disclosed in U.S. Pat. Nos. 7,361,102, 7,927,233, 8,834,300, 8,845,456, 9,205,308, and 9,795,836, which are each incorporated in their entirety as if fully set forth herein.

Exemplary golf ball constructions are also disclosed in commercially available golf balls, such as the following golf balls which are produced by Titleist: Pro V1, Pro V1x, Pro V1x Left Dash, Pro V1 Left Dot, AVX, Tour Speed, Tour Soft, Velocity, and TruFeel. The dimple profiles disclosed herein can be implemented with any of the foregoing golf ball constructions.

Different materials also may be used in the construction of the golf balls made with the present disclosure. For example, the cover of the golf ball may be made of a polyurea material, a polyurethane-urea hybrid material, a polyurea-urethane hybrid material, ionomer material, or any other suitable cover material known to those skilled in the art. Different materials also may be used for forming core and intermediate layers of the golf ball.

The golf ball dimple profiles of the present disclosure can be part of an overall dimple pattern selected to achieve various desired aerodynamic characteristics. Dimple patterns that provide a high percentage of surface coverage are well known in the art. For example, U.S. Pat. Nos. 5,562,552, 5,575,477, 5,249,804, and 4,925,193, which are each hereby incorporated by reference in their entirety as if fully set forth herein, disclose geometric patterns for positioning dimples on a golf ball.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

The terms "first," "second," and the like are used to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the disclosure.

The golf balls described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the device in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety.

What is claimed is:

1. A golf ball having a plurality of dimples on a surface thereof, wherein at least a subset of the plurality of dimples has a cross-sectional dimple profile defined by x-y coordinates, wherein x=0 corresponds to a central axis of the cross-sectional dimple profile, $y=-c_d$ corresponds to a maximum depth of the cross-sectional dimple profile which is defined at the central axis, and the cross-sectional dimple profile is symmetrical about the central axis, wherein a cross-sectional dimple profile is defined by a modified cycloid curve, and the modified cycloid curve is rotated about the central axis to define the cross-sectional dimple profile of the plurality of dimples, wherein the modified cycloid curve is defined by:

$$\begin{cases} x = \frac{D}{2\pi}(\theta - \sin\theta) - \frac{D}{2} \\ y = \frac{c_d}{2}(\cos\theta - 1) \end{cases}, \text{ with } 0 \le \theta < 2\pi$$

where D is a dimple diameter, $c_d$ is a chord depth, and $\theta$ is an angular displacement along the modified cycloid curve.

2. The golf ball according to claim 1, wherein an intersection angle of each dimple among the subset of the plurality of dimples is least 90 degrees.

3. The golf ball according to claim 1, wherein the subset of the plurality of dimples includes at least 50% of a total quantity of the plurality of dimples.

4. The golf ball according to claim 1, wherein the subset of the plurality of dimples includes at least 75% of a total quantity of the plurality of dimples.

5. The golf ball according to claim 1, wherein the subset of the plurality of dimples includes 100% of a total quantity of the plurality of dimples.

6. The golf ball according to claim 1, wherein the dimple diameter of each dimple among the subset of the plurality of dimples is 0.100 inches-0.225 inches.

7. The golf ball according to claim 1, wherein the dimple diameter of each dimple among the subset of the plurality of dimples is 0.125 inches-0.180 inches.

8. The golf ball according to claim 1, wherein the chord depth of each dimple among the subset of the plurality of dimples is 0.0025 inches-0.0075 inches.

9. The golf ball according to claim 1, wherein the chord depth of each dimple among the subset of the plurality of dimples is 0.0040 inches-0.0055 inches.

10. The golf ball according to claim 1, wherein the cross-sectional dimple profile has a continuously variable radius of curvature.

11. A golf ball having a plurality of dimples on a surface thereof, wherein at least a subset of the plurality of dimples has a cross-sectional dimple profile defined by x-y coordinates, wherein x=0 corresponds to a central axis of the cross-sectional dimple profile, $y=-c_d$ corresponds to a maximum depth of the cross-sectional dimple profile which is defined at the central axis, and the cross-sectional dimple profile is symmetrical about the central axis, wherein a cross-sectional dimple profile is defined by a modified cycloid curve, and the modified cycloid curve is rotated about the central axis to define the cross-sectional dimple profile of the plurality of dimples, wherein x-coordinates of the modified cycloid curve are only dependent on a dimple diameter and an angular displacement along the modified cycloid curve, and y-coordinates of the modified cycloid curve are only dependent on a chord depth and an angular displacement along the modified cycloid curve.

12. The golf ball according to claim 11, wherein an intersection angle of each dimple among the subset of the plurality of dimples is least 90 degrees.

13. The golf ball according to claim 11, wherein the dimple diameter of each dimple among the subset of the plurality of dimples is 0.100 inches-0.225 inches.

14. The golf ball according to claim 11, wherein the chord depth of each dimple among the subset of the plurality of dimples is 0.0025 inches-0.0075 inches.

* * * * *